United States Patent [19]

Oda

[11] Patent Number: 4,854,232

[45] Date of Patent: Aug. 8, 1989

[54] METHOD AND APPARATUS FOR MULTI-COLOR PRINTING

[75] Inventor: Osamu Oda, Kyoto, Japan

[73] Assignee: Dainippon Screen Mfg. Co. Ltd., Japan

[21] Appl. No.: 107,264

[22] Filed: Oct. 9, 1987

[30] Foreign Application Priority Data

| | | | |
|---|---|---|---|
| Oct. 13, 1986 | [JP] | Japan | 61-241398 |
| Oct. 17, 1986 | [JP] | Japan | 61-245189 |
| Feb. 25, 1987 | [JP] | Japan | 62-40398 |
| Feb. 25, 1987 | [JP] | Japan | 62-40399 |

[51] Int. Cl.[4] ..... B41M 1/14

[52] U.S. Cl. ..... 101/211; 101/137; 101/146; 101/177

[58] Field of Search ..... 101/211, 137, 146, 177

[56] References Cited

U.S. PATENT DOCUMENTS

| | | | |
|---|---|---|---|
| 20,276 | 5/1858 | Korff | 101/148 |
| 509,120 | 11/1893 | Earhart | 101/211 |
| 537,023 | 4/1895 | Edmonson | 101/211 |
| 565,891 | 8/1896 | Frauenfelder | 101/211 |
| 640,633 | 1/1900 | Corbin | 101/175 |
| 648,285 | 4/1900 | Orloff | 101/211 |

*Primary Examiner*—Clifford D. Crowder

*Attorney, Agent, or Firm*—Ostrolenk, Faber, Gerb & Soffen

[57] ABSTRACT

In a method of multi-color offset printing each of a plurality of blankets is contacted with respective printing plates corresponding to each color of the blankets to transfer their respective colors to each of the blankets. Then, each of the blankets is contacted with respective preceding printing plates whose colors are respectively printed prior to that of each of the blankets for transferring color ink of the respective preceding color printing plates to each of the blankets. Next, each of the blankets is pressed in the predetermined order onto a sheet of printing paper to transfer each color ink to the printing paper one after one another.

7 Claims, 10 Drawing Sheets

METHOD AND APPARATUS FOR MULTI-COLOR PRINTING

BACKGROUND OF THE INVENTION

1. Field of the Invention

The present invention relates to a multi-color offset printing method and a printing press for printing a multi-colored image pattern by using a plurality of color inks, and particularly to such a method and apparatus which can shorten the rising time necessary for stabilizing printing conditions from the beginning of printing.

2. Prior Art

Known offset printing presses used for multi-color offset printing are operated with the following fundamental processes.

(1) Each printing plate is damped.

(2) A plurality of color printing inks are supplied to an image area of each of the corresponding printing plates by inking arrangements.

(3) An ink (hereinafter referred to "a color pattern ink") supplied to an image area of each plate is transferred to respective corresponding blankets in a predetermined order.

(4) The color pattern ink transferred to the blankets is overlapped on a sheet of paper so that each of the color images may be properly aligned to obtain a desired color print.

As described above, conventional offset printing utilizes a printing method in which inks are not transferred directly to paper from the plates, but transferred to paper through a blanket. Hereinafter, outlines of the mechanism and operation of several kinds of multi-color offset presses which carry out offset printing are described.

FIG. 10 is a sectional view of a four color offset proofing press for carrying out a continuous printing operation on sheet paper (hereinafter a press of this type is referred to as "a rotary press"), which is described in the specification of U.S. Pat. Nos. 3,536,006 and 3,347,160. The apparatus comprises a plate cylinder (103) on the outer circumference thereof; printing plates (101) (101*b*) (101*c*) and (101*d*) respectively for four colors being provided in a required order; a blanket cylinder (107) on the outer circumference of which four blankets (105*a*) (105*b*) (105*c*) and (105*d*) having the same diameter as that of the plate cylinder (103) and corresponding to each of the colors being provided in a required order; and a printing cylinder (109) having a diameter of one fourth of that of the plate cylinder (103) and the blanket cylinder (107), and on the outer circumference of which papers are to be set. Here, each of the alpha suffixes attached to the reference number (i.e., a, b, c and d) represents a respective color of printing ink applied to the corresponding parts and also the printing order; and a reference number to which no suffix is attached (e.g. 103) indicates the part in generic.

The apparatus shown in FIG. 10 is arranged such that, during one revolution of the plate cylinder (103) in the direction shown by an arrow mark, water is supplied to each of plates (101*a*) (101*b*) (101*c*) and (101*d*) from respective damping devices (113*a*) (113*b*) (113*c*) and (113*d*) to damp each of the plates. Then, from each of inking arrangements (111*a*) (111*b*) (111*c*) and (111*d*) corresponding to respective colors a color ink is supplied to each of the plates to form a color image on the respective plates. During one revolution of the blanket cylinder (107) which rotates in contact with the plate cylinder (103), the color images on the plates are transferred to the corresponding blankets (105*a*) (105*b*) (105*c*) and (105*d*), respectively.

On the other hand papers are fed from a paper feeder (115) to the outer circumference of the printing cylinder (109), and, during one revolution of the blanket cylinder (107), the printing cylinder (109) in contact with the blanket cylinder (107) rotates four turns, and inks of the color images on the blanket are overlapped on the paper and transferred thereto. The paper on which four color inks are printed is fed to a paper receiving tray (117).

An apparatus shown in FIG. 11 is another rotary type four color offset proofing press, which is described on pp. 47–50 in a publication entitled "Duetcher Drucker Nr. 33/18-10-1984". This apparatus comprises four plate cylinders (121*a*) (121*b*) (121*c*) and (121*d*), each of which has one of four printing plates on its outer circumference; four blanket cylinders (123*a*) (123*b*) (123*c*) and (123*d*) having the same diameter as that of the plate cylinders, each of the outer circumference of them being provided with a blanket and each of them being rotated in contact with the corresponding plate cylinders, respectively; and a printing cylinder (125) having a diameter of about three times that of the plate cylinders and the blanket cylinders. To each of the plate cylinders (121*a*) (121*b*) (121*c*) and (121*d*) there are attached inking arrangements and a damping device, respectively.

The apparatus of FIG. 11 is of the same type as that shown in FIG. 10, and forms color images on the printing plates by feeding an ink from each inking arrangement to a respective corresponding plate; and the apparatus then prints each of the color pattern inks on the same area of a paper through each of the blankets. According to the rotations of the printing cylinder (125), a sheet of paper fed from a paper feeder (127) passes through points at which each of the blanket cylinders (123*a*) (123*b*) (123*c*) and (123*d*) contacts the printing cylinder (125) in order; and the paper color images of the respective color inks are overlapped and thus printed. The paper on which a printing of four colors is made is fed to a receiving device (129).

FIG. 12 shows a four color offset proofing press disclosed in British Patent Laid-Open Publication No. 2164295A. The apparatus disclosed in this publication is of a different type from the above-described two rotary type apparatus, and includes a flat table type on which printing plates are loaded planarly. The proofing press of FIG. 12 is provided with a frame (146) having tables or beds (141) (142) (143) and (144) on which printing plates of each color are to be loaded; a set of damping devices (166) and inking arrangements (181) (182) (183) and (184) for each color. In addition, in a carriage (148) which travels on the frame (146) there are provided a blanket cylinder (150) on the outer circumference of which four blankets (151) (152) (153) and (154) are loaded; a printing cylinder (158) having a diameter of one fourth of that of the blanket cylinder (150); water supplying rollers (160) for supplying damping water to a water distributing plate (168); damping rollers (161) (162) (163) and (164) for each color, and inking rollers (171) (172) (173) and (174) for each color.

When the carriage (148) is driven from the right side to the left, the blanket cylinder (150) is raised to separate from the surfaces of the tables or beds (141) - (144), and the damping rollers (161)–(164) and the inking rollers (171)–(174) make contact their corresponding printing plates so that the damping water and the color inks are supplied to the plates. Next, when the carriage (148) is driven from the left side to the right side, each of the color pattern inks formed on each of the plates is transferred to the blankets (151) (152) (153) and (154) loaded on the blanket cylinder (150). A paper to be printed is loaded on the outer circumference of the printing cylinder (158) and during one revolution of the blanket cylinder (150), the printing cylinder (158) which contacts with the blanket cylinder (150) revolves four times, and the color pattern inks on the blankets (151) (152) (153) and (154) are transferred in order to the paper so as to print a four color image thereon.

FIG. 13 shows a two color offset proofing press of a flat table type disclosed in British Patent Laid-Open Publication No. 2024105. In a frame (118) of this apparatus there are provided two plate tables (112) and (114) on which printing plates are to be loaded; a paper table (116) on which papers to be printed are loaded; a damping device (132) and two sets of inking arrangements (134) and (136). Further, in a carriage (120) which travels on the frame (118) there are provided two blanket cylinders (122) and (124) on each of the outer circumferences of which a respective blanket is loaded, a set of damping rollers (126) and two sets of inking rollers (128) and (130).

When the carriage (120) is driven from the right side to the left side, then in the same manner as for the apparatus shown in FIG. 12, damping water is supplied from the damping roller (126) to the plates loaded on the tables (112) and (114), and a color ink is supplied from the inking rollers (128) and (130) to the corresponding plate(s). On the other hand when the carriage (120) is driven inversely, that is, driven from the left side to the right side, color pattern inks on the plates are transferred to the corresponding blanket of the blanket cylinder (122) or (124), and then such inks are transferred onto a paper on the paper table (116) in order. Thus, a two color image is printed.

In those above-described, various types of multicolor offset proofing presses, blankets for each color are pressed, in order, onto a paper to transfer each color pattern ink to the paper, and a four- or two-color image is printed. In this case, because the first color ink printed on the paper from the blanket of the first color contacts the surfaces of the second blanket and those of the following ones, a phenomenon in which inks on the paper are transferred to the surfaces of the following blankets, i.e., so-called "back trapping", occurs; accordingly, ink quality on the paper is remarkably depreciated, so that excellent ink quality for obtaining a desired printing result cannot be achieved.

In each of the above-described apparatuses, immediately before starting a printing operation only one color ink corresponding to each of the blankets is to be transferred, and each of these blankets is contacted, in order, with the same paper. For example, considering the first color ink, after such first color ink has been transferred from the first color blanket to the paper, but while still wet, the second blanket contacts the paper, so that a part of the first coloring on the paper is transferred to the second color blanket. Thus, the so-called "back trapping" phenomenon occurs. In the case of the paper contacting the third and the fourth color blankets in the same manner as described above, the first color ink on the paper is also transferred to the following blankets, so that when the fourth color image is printed, the quantity of the first color on the paper decreases below that necessary for obtaining a desired printing effect.

When printing of four colors on the first paper is finished, on the second, the third and the fourth blankets there still remains some amount of the first color ink contrarily transferred thereto from the first paper; however, the quantity of such ink is small, and the further the printing order proceeds, the smaller the quantity of such ink on the blanket becomes. Accordingly, even in the printing operation to the second paper, as well as in the above case, the first color ink is transferred to the second blanket and those of the following ones, so that insufficiency of the first color also occurs in a printed image.

Regarding the second color ink or the third color ink, conditions are quite similar as those of the first color ink, that is, the second color ink is contrarily transferred to the third and the fourth blankets, and the third color ink is contrarily transferred to the fourth blanket, so that quantities of these color inks are insufficient in a finished printing. Such phenomena as has occurred in the above-described cases in which quantities of color inks become insufficient in an early print do not occur after a number of papers have been printed. This is because, if quantities of color inks of the preceding order are saturated on the following blankets, printing conditions become stabilized. However, a considerably large number of papers must be printed to reach the stabilized condition. Usually, the number of color printings required from an offset proofing press is relatively small. Therefore, in preliminary printing until the offset proofing press reaches a stabilized condition, an unduly large number of papers and a large quantity of ink are needed, and this problem is further compounded by the need for troublesome preliminary working of the press.

SUMMARY OF THE INVENTION

It is an object of the present invention to provide a method and an apparatus for multi-color offset printing which can reduce the above-described disadvantages of the prior art.

It is another object of the present invention to provide a method and an apparatus for shortening rising time, that is, the time from start-up to reach a stabilized condition for multi-color printing.

In a preferred method and apparatus for offset proof printing, savings of materials and labels is achieved by directly supplying a color ink for a preceding printing from a preceding printing plate to the following blanket, and by previously saturating the blankets with color ink so that different color ink may be prevented from being contrarily transferred to the blanket from a paper.

Other advantages and objects of the present invention will become more apparent as the following description is considered with reference to the accompanying drawings.

DETAILED DESCRIPTION OF THE PREFERRED EMBODIMENTS

Figure 1:
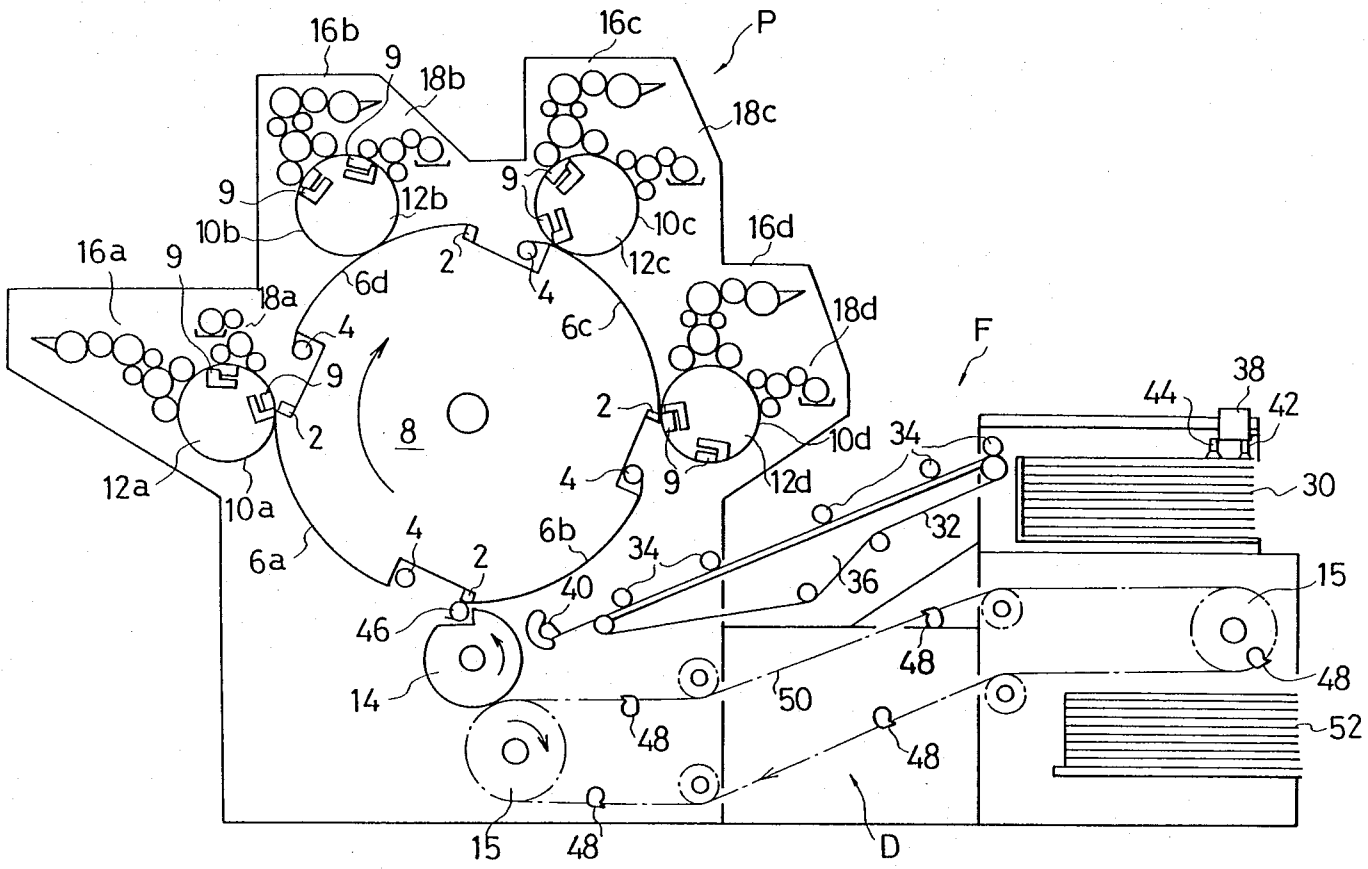
FIG. 1 is a view showing a schematic construction of an embodiment of a rotary type offset proofing press according to the present invention.

The rotary type offset proofing press shown in FIG. 1 is composed of a printing section (P), a feeder section (F) for feeding papers to be printed and a delivery section (D) for feeding out and piling up printed papers. The printing section (P) comprises a blanket cylinder (8) loaded with four blankets (6*a*) (6*b*) (6*c*) and (6*d*) on the outer circumference thereof by retainers (2) and stretchers (4); four plate cylinders (12*a*) (12*b*) (12*c*) and (12*d*) having on their respective, outer circumferences a respective printing plate (10*a*) (10*b*) (10*c*) or (10*d*) affixed by means of vises (9), and each of which four plate cylinders has the same diameter which is one fourth of that of the blanket cylinder (8); and a printing cylinder (14) having the same diameter as those of the plate cylinders (12*a*)-(12*d*). The working "diameter of the blanket cylinder (8)" indicates fundamentally a diameter at the loaded portions (6*a*)-(6*d*) of the blanket cylinder (8); each of the diameters of the plate cylinders (12*a*)-(12*d*) indicates respective diameters including thickness of each of the printing plates (10*a*)-(10*d*); and the diameter of the printing cylinder (14) indicates a diameter including thickness of a paper. Dimensions of these diameters, as well as those having been practiced generally in the art of printing press, can be slightly varied in ratio according to printing conditions; therefore, it should be understood that ratios of diameters of the cylinders can include such variations.

Since the apparatus shown in FIG. 1 is a four color printing press, the ratio of diameters between the blanket cylinder (8) and the plate cylinders (10*a*) (10*b*) (10*c*) (10*d*) and the printing cylinder (14) is defined as 4:1; however, of course, if the apparatus is a six color printing press, then ratio of diameters is 6:1; and in the case of an eight color printing press, the ratio becomes 8:1. Thus, any design is possible so that ratio may become n:1 in accordance with the number of colors (n). To each of the plate cylinders (12*a*) (12*b*) (12*c*) and (12*d*) respective color inking arrangements (16*a*) (16*b*) (16*c*) (16*d*) and damping devices (18*a*) (18*b*) (18*c*) (18*d*) are attached.

The inking arrangements (16) and the damping devices (18) are adapted so that they may always contact the corresponding plate cylinders (12), respectively, or may be adapted so that they may contact the corresponding plate cylinders (12), respectively, only when the plate cylinder (12) is separated from the blanket (8).

Figure 2B:
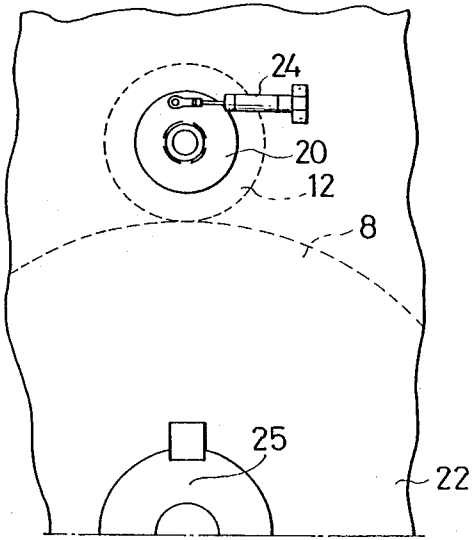
FIGS. 2A and 2B show an embodiment of a plate cylinder shifting device.
Figure 2A:
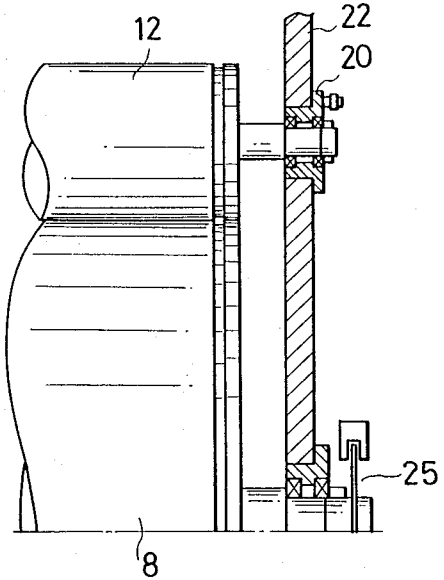

As shown in FIGS. 2A and 2B, each of the plate cylinders (12) is supported at both ends of its shaft with eccentric bearings (20). The eccentric bearings (20) are connected with a rod of a pneumatic cylinder (24) mounted on a side frame (22), and shift the plate cylinder (12) to a position at which it contacts the outer circumference of the blanket cylinder (8) and to another position at which it separated from the blanket cylinder (8). The eccentric bearings (20) are rotated by movement of the rod. Further, at one end of the shaft of the blanket cylinder (8) there is provided a rotary encoder (25) for detecting the angle of rotation of the blanket cylinder (8).

Figure 4:
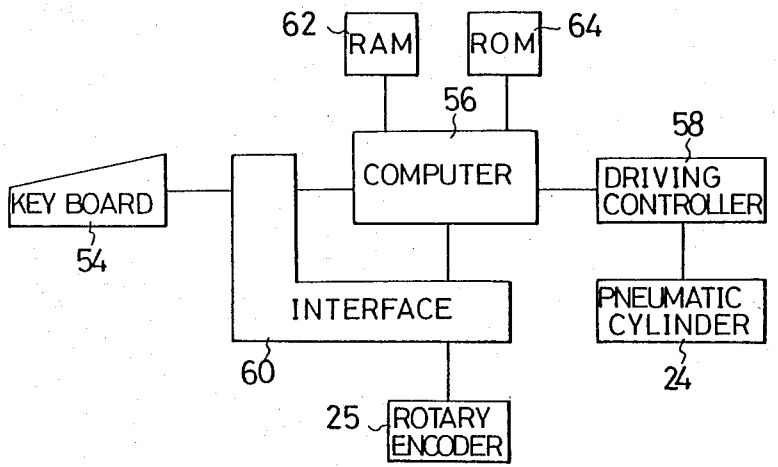
FIG. 4 is a block diagram of a control circuit for shifting the plate cylinder.

FIG. 4 is a block diagram of a circuit for controlling shifting of the plate cylinder (12). The control circuit is composed of a keyboard (54) which is a data input device, a computer (56), a pneumatic cylinder driving means (58), an interface (60) etc. In order to contact each of the plate cylinders (12) (FIG. 1) with the blanket cylinder (8) at a desired angular position thereof, at first a program for transferring a color pattern ink for the preceding printing to the blanket of a later color print and also a printing program of a usual regular method are input to a RAM (62) (FIG. 4) of the computer (56) by the keyboard (54); or, in the case of applying a program previously stored in a ROM (64) of the computer (56), the keyboard (54) selects it.

When the blanket cylinder (8) (FIG. 1) starts rotating, a pulse signal from the rotary encoder (25) is input to the computer (56) through an interface (60), and an angular position of the blanket cylinder (8) or angular positions of each of the blankets is calculated. Based on data of the calculated angular positions, a control signal is input to the pneumatic cylinder driving means (58) at the position where the plate cylinders should contact the blanket cylinder and at the position where the former should separate from the latter. The pneumatic cylinder drive means (58) drives the pneumatic cylinder (24) by the control signal from the computer (56), and by rotating the eccentric bearings (20) at a required angle based on the movement of the rod, each of the plate cylinders (12*a*)-(12*d*) is shifted at each of their required positions between the position at which it contacts the blanket cylinder (8) and the position at which it separates from the blanket cylinder (8).

Figure 3B:
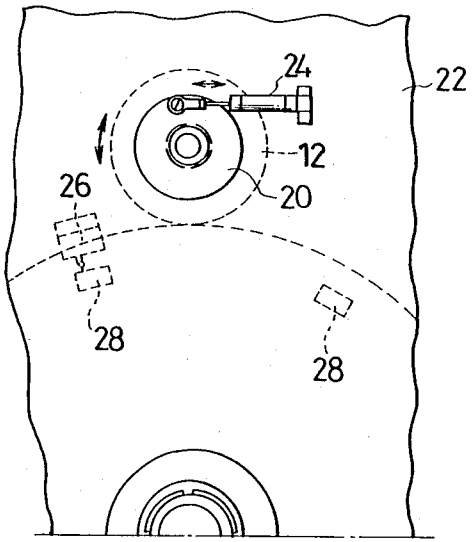
FIGS. 3A and 3B show another embodiment of a plate cylinder shifting device.
Figure 3A:
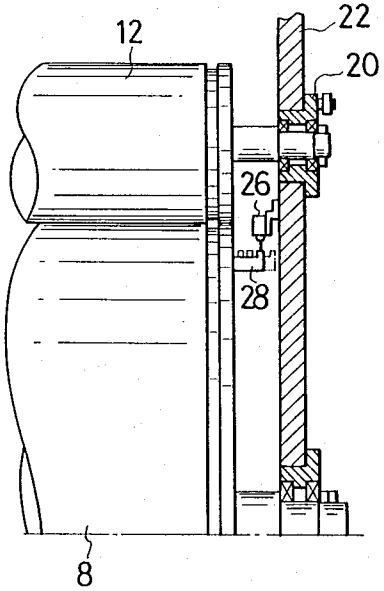

FIGS. 3A and 3B show another embodiment in which limit switches are used instead of the rotary encoder to shift the plate cylinders. The four limit switches (26) (FIG. 3B) are provided at respective axial positions of the side frame (22) which coincide with the axial positions of the respective plate cylinders (12*a*) (12*b*) (12*c*) and (12*d*) through adjustment of the axial positions of the cylinders; and at each of the relatively identical positions of the end surface of the blanket cylinder (8) to the respective blankets (6*a*) (6*b*) (6*c*) and (6*d*), actuators (28) are provided to engage with the respective limit switches (26). For each of the limit switches (26) two actuators (28) are provided, and their axial positions are respectively aligned with cooperating limit switches. Signals from the limit switches (26) are input to the computer (56) (FIG. 4) instead of signals from the rotary encoder (25) of the embodiment shown in FIGS. 2A and 2B. By each signal relating to the preceding actuator among the respective pairs of actuators (28), a respective plate cylinder (12*a*)-(12*d*) corresponding thereto is contacted with the blanket cylinder (8), and by a signal relating to the following actuator the plate cylinder is separated from the blanket cylinder (8).

The feeder section (F) (FIG. 1) is composed of a paper storage section (30), an endless belt (32), a conveyor (36) provided with a plurality of rollers (34), a suction means (38) for moving papers from the paper storage (30) to the conveyor (36), and a swing gripper (40). The suction means (38) has two sets of suction devices (42) and (44). Suction means (38) operates as follows, that is, at first the uppermost paper among papers piled in the paper storage (30) is held by the suction devices (42) and raised, and then the raised paper is advanced by the suction devices (44) until it becomes inserted between the endless belt (32) and the first roller (34) so that it may be transported by the conveyor (36). The transported paper is, as is conventional, delivered to grips (46) of the printing cylinder (14) by the swing gripper (40) provided at one end of the conveyor (36).

The delivery section (D) is composed of a delivery cylinder (15) which contacts with the printing cylinder (14) and rotates in synchronization with the printing cylinder (14) and an endless chain (50) provided with delivery grips (48) each of which has a constant pitch therebetween. The pitch of the deliver grips (48) is the same as that between each of the adjacent blankets (6); that is, it is adapted to coincide with circumferential lengths of the printing cylinder (14) and the plate cylinder (12). Thus, the deliver grips (48) receive printed papers from the printing cylinder (14) and transports them to a receiving stand (52).

Hereinafter, operation of the above-mentioned apparatus is described by considering two processes; one with respect to the regular printing process and the other for a preparing process.

In the regular printing process, the four plate cylinders (12*a*) (12*b*) (12*c*) (12*d*) and the printing cylinder (14) rotate in synchronization with the blanket cylinder (8), and the chain (50) is driven to pass through the outer circumference of the delivery cylinder (15). The printing plates (10) loaded on the respective plate cylinders (12) are supplied with damping water from the damping devices (18), and each color ink is supplied to the respective printing plates from each of the inking arrangements (16). When each of the leading edges of the blankets (6*a*)–(6*d*) arrives at each of the contact positions of the respective corresponding plate cylinders (12*a*)–(12*d*), a pneumatic cylinder (24) (FIG. 4) is actuated by a pulse signal of rotary encoder (25) which is input to computer (56) through interface (60), and the eccentric bearings (20) begins to rotate to let plate cylinder (12) contact the blanket cylinder (8). Thus, "setting on" is performed. FIG. 1 shows the case in which the plate cylinder (12*a*) of the first color is in this situation.

The blanket cylinder (8) rotates further, and the trailing edge of the blanket (6) arrives at the contact position with the plate cylinder (12). Then the pneumatic cylinder (24) is actuated via the interface (60), the pneumatic cylinder (24) is returned to the original position, and the plate cylinder (12) separates from the blanket cylinder (8).

Figure 6:
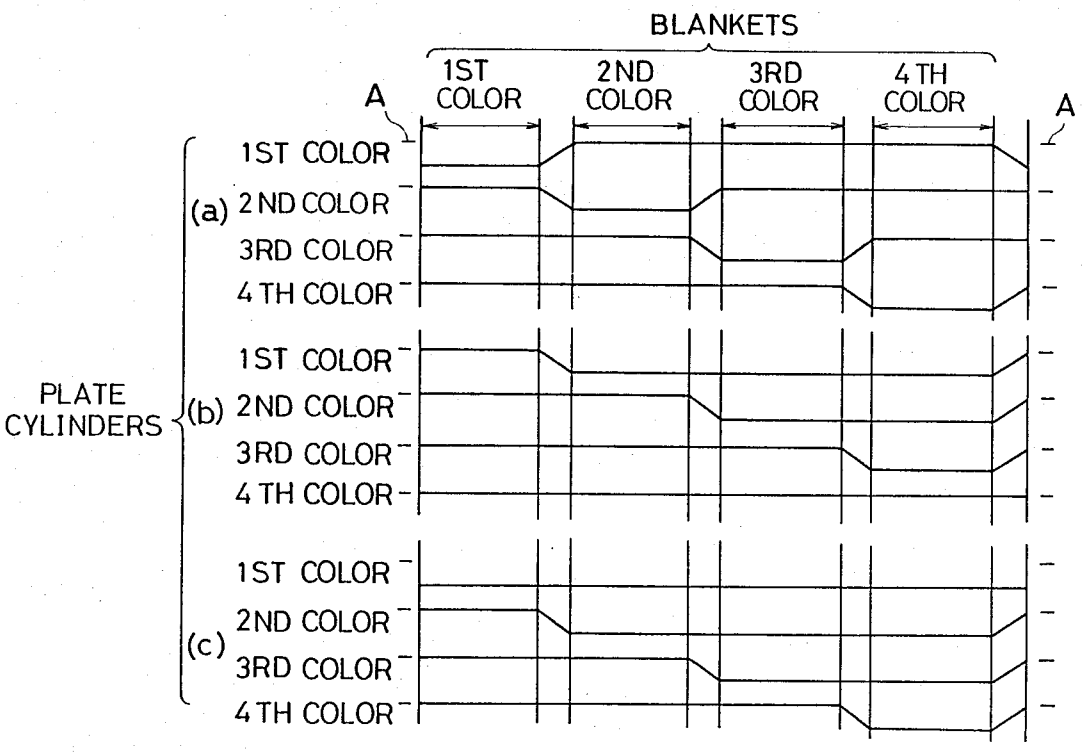
FIGS. 6 and 7 are time charts of operations of the plate cylinders of the rotary type offset proofing press shown in FIG. 1.

FIG. 6(*a*) shows time charts representing motions of the four plate cylinders (12) in one rotating cycle of the blanket cylinder (8). In FIG. 6(*a*) lines of level indicated by an index A represent periods for the plate cylinders (12) separating from the blanket cylinder (8), and the lower lines represent periods for the plate cylinders (12) coming to contact with the blanket cylinder (8). Further, the time chart shown in FIG. 6(*a*) is a time chart for a case in which four plate cylinders are arranged around the blanket cylinder each separating one another by an angular interval of 90 degrees with an equiangular phase, respectively. In fact in the arrangement of the plate cylinders shown in FIG. 1, lines of the plate cylinders of the second color to the fourth color are shown such as shifted to the left side, respectively.

The printing cylinder (14) always contacts the blanket cylinder (8), and rotates four times for each rotation of the blanket cylinder (8).

In a regular printing process one sheet of paper to be printed is fed from the paper storage (30) to the printing cylinder (14) every one rotation of the blanket cylinder (8), and loaded on the outer circumference of the printing cylinder (14). Thus, according to four turns of the printing cylinder (14), four of the blankets (6) contact the fed paper in sequence to form a four-color print image.

Next, the paper is held by the delivery grips (48) on the endless chain (50), and fed to the receiving stand (52). In this case since the delivery grips (48) are arranged on the endless chain (50) with the same pitch as the circumference length of the printing cylinder (14), one of the four grips (48) is used.

Next described in the process according to the present invention for supplying ink to the blankets for later printing by the plates for the preceding printing in the above-mentioned four color offset proofing rotary press.

FIG. 6(*b*) is a time chart showing a fundamental aspect of the present invention. FIG. 6 indicates timing of contact and separating between each of the plate cylinders (12) and the blanket cylinder (8) during preparing steps prior to the beginning of printing operation. To facilitate understanding there are assumed shown, as assumed for FIG. 6(*a*), four plate cylinders arranged with an equi-interval and 90 degrees different phases with one another.

During one revolution of the blanket cylinder (8), the plate cylinder (12*a*) for the first color is set on the blankets (6*b*) (6*c*) and (6*d*) for the second, the third and the fourth colors, respectively; the plate cylinder (12*b*) for the second color is set on the blankets (6*c*) and (6*d*) for the third and the fourth colors, respectively; and the plate cylinder (12*c*) for the third color is set on the blanket (6*d*) for the fourth color. As described above, each of the color pattern inks on the respective plates is supplied to each of the blankets required for later printing. If a required quantity of ink is supplied to the blanket for later printing, and if printing is carried out with the same process as the above-described regular method, then even at the beginning of the multi-color printing, conditions nearly similar to those where certain times of printing operation have already been carried out can be obtained; that is, conditions similar to those where ink for the preceding printing is contrarily transferred onto the blanket for the later printing and saturates the blanket, can be obtained. As a result, the ink is prevented from being contrarily transferred to the blanket for the later printing, and printing conditions are stabilized so that good printing results may be obtained.

A preferred operation of the present invention is now described.

Prior to supplying ink from a plate for preceding printing to the blanket for later printing, according to the regular process shown in FIG. 6(*a*), each color image ink is supplied to the respective corresponding blankets 6(*a*)–6(*d*) by each of the printing plates (10*a*)–(10*d*) loaded on the respective plate cylinders (12*a*)–(12*d*). Ink supplying work according to the regular process is performed for the following reason. That is, in the case of a halftone image composed of screen dots, particularly in an area of large dot percentage, dots of one color are printed by partly overlapping with dots of other colors. In this case it is considered that even on the blankets there must e parts overlapped with plural color ink; however, in fact, ink supplied thereafter is repelled by pre-existing ink, and cannot adhere to the blanket, so that no overlapping condition occurs. Accordingly, since the proper quantity of each color ink to be printed by each of the blankets is supplied on the respective blankets, each color pattern ink is previously supplied to the respective blankets (6*a*)–(6*d*) by the regular process.

Next, the ink for the preceding printing is supplied to the blanket for the later printing by the preceding printing plate. This operation is performed, as shown FIGS. 7(*a*), 7(*b*) and 7(*c*), during three turns of the blanket cylinder (8). To facilitate understanding, time charts shown in FIGS. 7(*a*), 7(*b*) and 7(*c*), as well as those shown in FIGS. 6(*a*) and 6(*b*), are for an arrangement in which each of the plate cylinders is provided on the outer circumference of the blanket cylinder with an equi-distance and in 90 degree different phase, respectively. At the first rotating period of the blanket cylinder (8), as shown in FIG. 7(*a*), the first color plate (10*a*) is set on the second color blanket (6*b*), the second color plate (10*b*) is set on the third color blanket (6*c*) and the third color plates (10*c*) is set on the fourth color blanket (6*d*), respectively.

Figure 7:
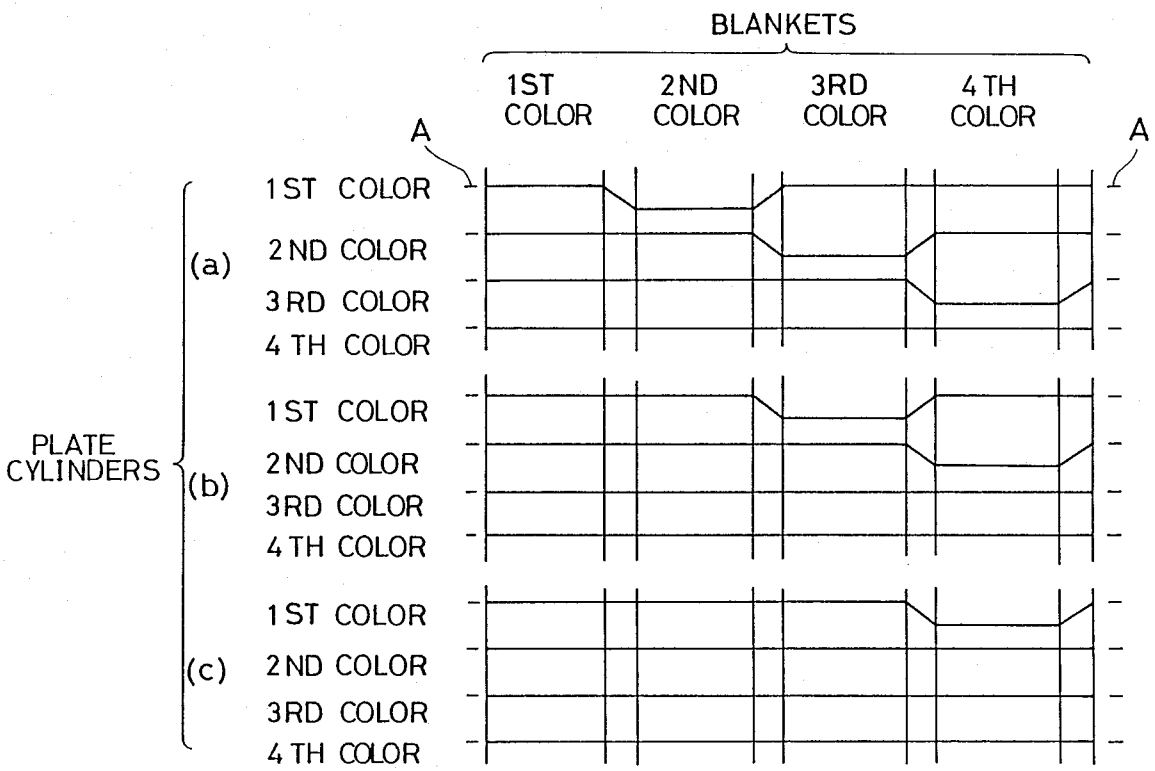

At the second rotating period of the blanket cylinder (8), as shown in FIG. 7(*b*), the first color plate (10*a*) is set on the third color blanket (6*c*) and the second color plate (10*b*) is set on the fourth color blanket (6*d*), respectively. At the third rotating period of the blanket cylinder (8), as shown in FIG. 7(*c*), the first color plate (10*a*) is set on the fourth color blanket (6*d*).

In order to supply the ink from the plate for the preceding printing to the blankets for the later printing, the process described already by referring to FIG. 6(*b*) may be applied; however, for the following two reasons it is preferable to apply a method comprising the three steps shown in FIGS. 7(*a*), 7(*b*) and 7(*c*).

The first reason lies in supplying a sufficient quantity of ink. For example, in the process shown in FIGS. 6(*b*), the first color plate (10*a*) supplies the ink three times from the second to the fourth blankets continuously, so that to the later blanket a smaller quantity of the ink is supplied, which results in a lack of ink quantity. The result is not only for the case of the first plate (10*a*) but also for the case of the second plate (10*b*).

The second reason relates to damping water. If the process shown in FIG. 6(*b*) is applied, for example, to the fourth color blanket (6*d*) the ink is supplied continuously by the three plates, i.e., the first, the second and the third plates (10*a*) (10*b*) and (10*c*). However, from these plates damping water is also supplied simultaneously with the ink. That is, in lithography printing, to prevent portions other than image areas from being inked, the plate is damped by water, so that the damping water is transferred to the blankets together with the ink. The image areas to be inked change according to ink colors, therefore, to areas among the image areas to be inked by an ink because the later printing water supplied from the plate(s) for the preceding printing remains.

In the continuous operation shown in FIG. 6(*b*), the ink for the later printing is continuously supplied, until the water supplied to the blanket from the plate(s) for the preceding printing evaporates, so that transferring of the ink for the later printing becomes insufficient, which results in a lack of ink quantity. The same conditions can be seen not only in the case of the fourth blanket (6*d*) but also in the case of the third blankets (6*c*). Then, as shown in FIGS. 7(*a*), 7(*b*) and 7(*c*), by defining the first color as a reference, during three revolutions of the blanket cylinder (8), each ink is supplied to each of the plates at every revolution of the blanket cylinder (8), and by arranging to transfer a color image ink to any one of the later color blankets, equal quantities of ink can be supplied to all the blankets (6*a*), (6*b*), (6*c*) and (6*d*). Further, the damping water supplied to the blankets can evaporate, as is conventional, during one revolution period of the blanket cylinder (8), so as to avoid problems resulting from insufficiency of ink supply for later printing.

After having completed the above-mentioned preparing steps, actual multi-color printing operation is started. At this time, as described above, during one revolution of the blanket cylinder (8), each color ink is transferred to each of the blankets (6*a*), (6*b*), (6*c*) and (6*d*) from the respectively corresponding plates (10*a*), (10*b*), (10*c*) and (10*d*), and then the process in which each color image ink on each of the blankets (6*a*)–(6*d*) is overlapped on a paper loaded on the printing cylinder (14) is repeated.

If the printing plate is a dry offset type which requires no damping water, and an inking arrangement can continuously supply a sufficient quantity of ink, the method shown in FIG. 6(*b*) may be applied for supplying an ink for preceding printing to the blanket(s) for later printing, or as shown in FIG. 6(*c*), proper color inks and the preceding color ink for each of the blankets may be supplied in parallel during one revolution period of the blanket cylinder (8).

The quantity of ink supplied to the blanket for later printing may be a sufficient level to prevent the ink from contrarily transferring to the blanket from the paper. According to this method, a smaller quantity of ink compared with that of ink supplied to the blanket in the regular printing operation may be sufficient. Accordingly, in the steps shown in FIGS. 7(*a*), 7(*b*) and 7(*c*), the ink for the preceding printing to the blanket for later printing is supplied only one time, while proper color ink is supplied twice: one time at the preparing step and the other time at the printing stage. If necessary, prior to the printing step, by supplying the ink several times, the quantity of proper ink is changed to those of other color inks. That is, contacting times of the printing plate with the blanket for the proper color are made larger than those of the printing plate with each of the blankets of other colors to make the quantity of proper color ink to be supplied to the blanket larger than that of the other inks.

The above-mentioned controlling of ink quantity is not limited to the contacting times of the above-described plate with the blanket, by any similar methods which have been applied with usual printing presses; for example, an adjusting method of contacting times of the inking rollers with the printing plate, or that of controlling the quantity of ink to be supplied to the inking roller from a ink fountain etc., may be used. These methods for controlling ink supply to the blanket can be used with a multi-color offset proofing press of the flat table type such as will be described hereinafter.

Figure 5:
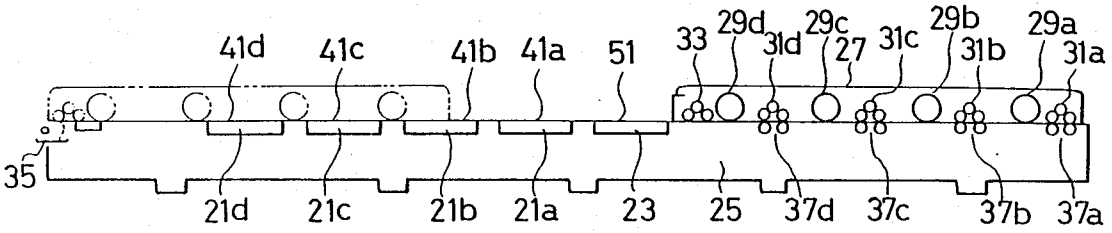
FIG. 5 is a block diagram of a control of a flat table type offset proofing press according to another embodiment of the present invention.

FIG. 5 is a schematic sectional elevation of a four color offset proofing press of the flat type for practicing the present invention. Four plate tables (21*a*) (21*b*) (21*c*) (21*d*) and a paper table (23) are mounted on a frame (25) in a line, and carriage (27) is driven along the line of the tables. On the carriage (27) there are provided four blanket cylinders (29*a*) (29*b*) (29*c*) and (29*d*) corresponding to four colors respectively, four sets of inking rollers (31*a*) (31*b*) (31*c*) (31*d*), and a set of damping rollers (33) which can be commonly used for each of the colors so that they may travel together with the carriage (27). At the left end of the frame (25) a damping means (35) for supplying damping water to the damping rollers (33) is provided, and at the right side of the frame (25) four sets of inking arrangements (37*a*) (37*b*) (37*c*) and (37*d*) which correspond to the four colors are provided and have the same pitch as that of the inking rollers (31*a*) (31*b*) (31*c*) and (31*d*).

The flat table type offset proofing shown in FIG. 5 is operated for proof printing in a regular process as follows. Firstly, each of printing plates (41*a*)–(41*d*) for respective proper colors is loaded on each of the four plate tables (21*a*)–(21*d*), and paper to be printed is loaded on the paper table (23). When the carriage (27) travels along the tables, at the left end of its stroke the damping rollers (33) engage with the damping means (35) to supply water, and at the right end of the stroke each of four sets of the inking rollers (31*a*)–(31*d*) engages with a respective one of inking arrangements (37*a*)–(37*d*) to supply the proper color ink. According to the travel of the carriage (27), the plates (41*a*)–(41*d*) loaded on the plate tables (21*a*)–(21*d*) respectively are damped by the damping rollers (33); and by the corresponding ink rollers (31*a*)–(31*d*), the proper color inks are supplied. When the carriage (27) returns, that is, when the carriage (27) travels from the left side to the right side, each of the inks on the respective plates (41*a*)–(41*d*) is transferred onto each of the outer circumferences of the corresponding blanket cylinders (29*a*)–(29*d*), and printed on a paper loaded on the paper table (23) to make up a four color print.

Figure 8:
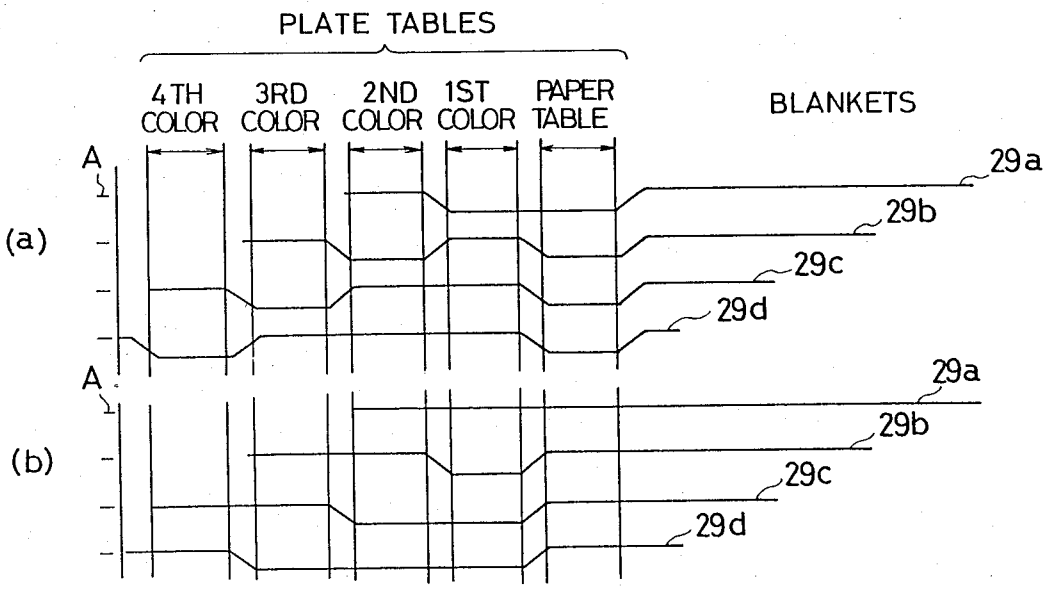
FIGS. 8 and 9 are time charts of operations of the flat table type offset proofing press shown in FIG. 5.

FIG. 8(*a*) is time chart showing vertical movements of the blanket cylinders (29*a*)–(29*d*) in this regular process, when the carriage (27) travels from the left side to the right side. Each of the blanket cylinders is applied to the plate tables corresponding to each of the blanket cylinders, and to each of them an inked color image of a plate is transferred, and then it is applied to the paper table to create a printed image. This regular printing process may use as a mechanism for moving the blanket cylinders vertically within a required area a mechanism such as described in British Laid-Open Publication No. 2024105, relating to a flat table type offset proofing press. Thus, detailed description of such mechanism is abbreviated.

Operation of the offset proofing press shown in FIG. 5 according to the present invention is as follows.

FIG. 8(*b*) shows the basic process of the present invention in which when the carriage (27) (FIG. 5) travels from the left side to the right side as shown in FIG. 5; the fourth blanket cylinder (29*d*) is set on the third, the second and the first plate tables; the third blanket cylinder (29*c*) is set on the second and the first plate tables; and the second blanket cylinder (29*c*) is set on the first plate table. Thereby, ink of a color image for a desired preceding printing is transferred.

A more preferred operation for the flat table type offset proofing press shown in FIG. 5 will now be described.

Similar to above-mentioned process for the rotary type offset proofing press shown in FIG. 1, in the flat table type offset proofing press of FIG. 5 an ink of a color image of a proper color is transferred to each of the blanket cylinders (29*a*)–(29) by the corresponding plates (41*a*)–(41*d*), respectively. Vertical movements of the blanket cylinders in this step are same as that of the case shown in FIG. 8(a); however, at the area of the paper table no setting on occurs.

Next, ink is transferred to the blanket cylinders for later printing from the plates of the preceding printing. These steps, as well as corresponding steps for the above-described preferred operation for a rotary type offset proofing press, are preferably practiced by the three steps as shown in FIGS. 9(*a*)–9(*c*).

Figure 9:
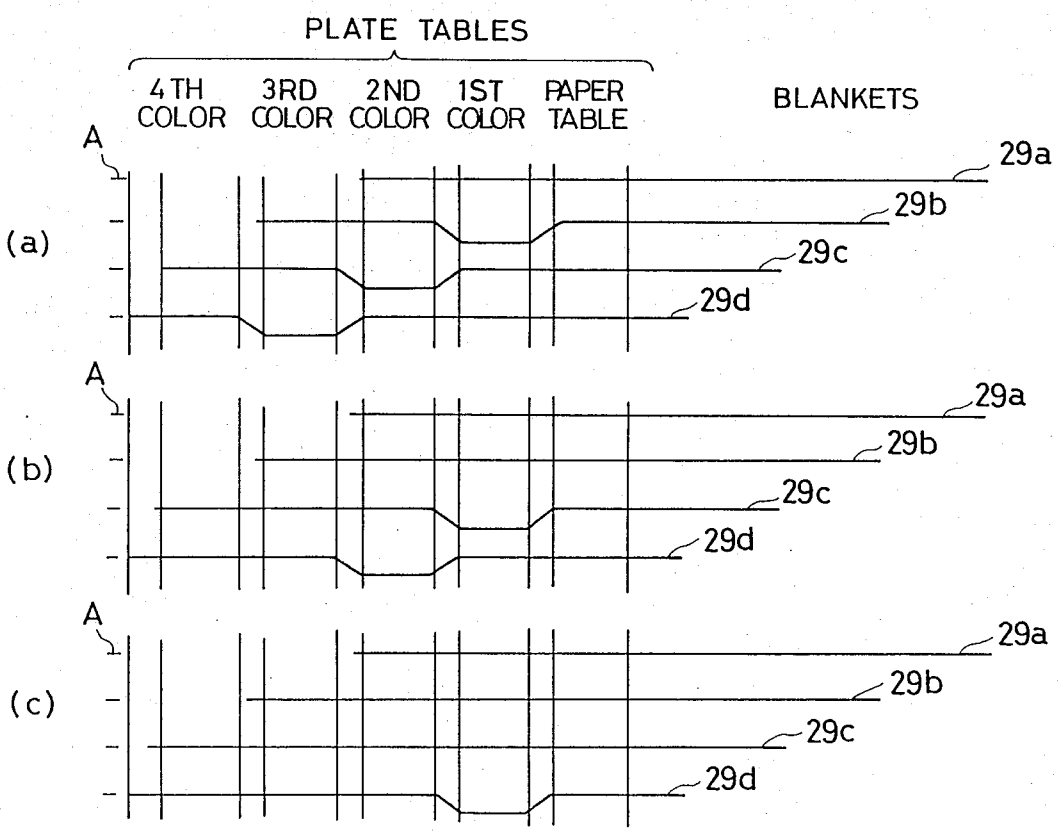
Figure 10:
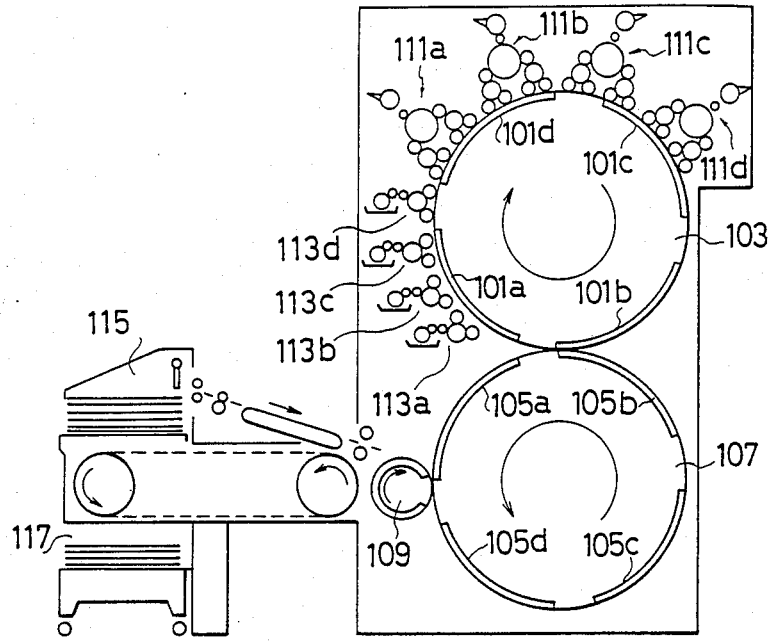
FIGS. 10, 11, 12 and 13 are schematics of the prior art as described above.
Figure 11:
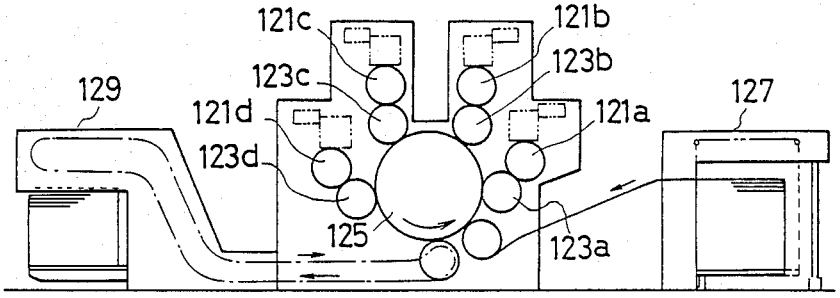
Figure 12:
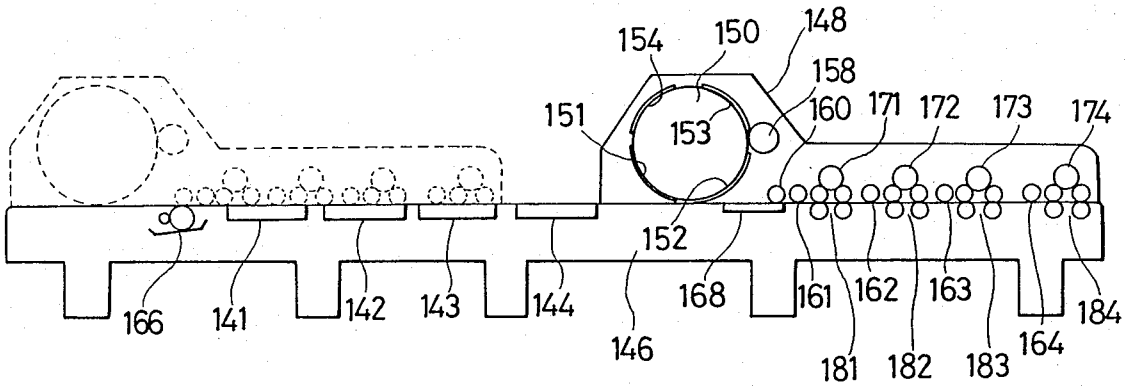
Figure 13:
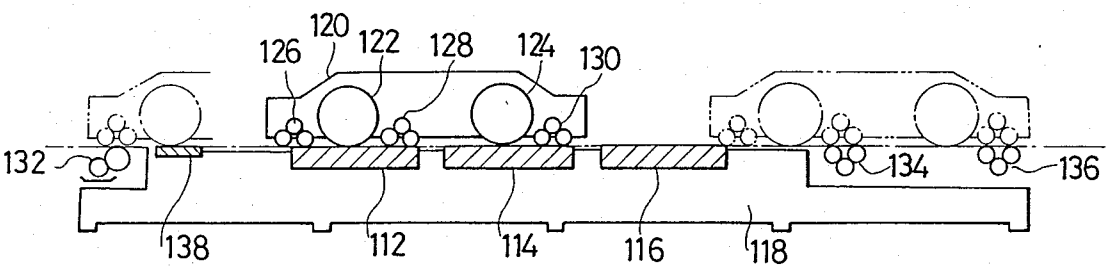

In the first transit of the carriage (27) (FIG. 5) from the left side to the right side of the frame (25), represented in FIG. 9(*a*), ink from the first plate (41*a*) is transferred to the second blanket cylinder (29*b*), ink from the second plate (41*b*) is transferred to the third blanket cylinder (29*c*), and ink from the third plate (41*c*) is transferred to the fourth blanket cylinder (29*d*). In the second transit, represented in FIG. 9(*b*), ink from the first plate (41*a*) is transferred to the third blanket cylinder (29*c*), and ink from the second plate (41*b*) is transferred to the fourth blanket cylinder (29*d*), respectively. Further, in the third transit, represented in FIG. 9(*c*), ink from the first plate (41*a*) is transferred to the fourth blanket cylinder (29*d*).

By the above-described three operation steps, after transferring ink for the preceding printing to the blanket for required later printing, a desired multi-color proofing image can be printed by carrying out multi-color printing according to the operation shown in FIG. 8(*a*).

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

I claim:

1. A method of multi-color offset printing wherein:

each of a plurality of blankets is contacted with respective corresponding color printing plates so as to transfer a different, respectively-colored ink to each of said blankets, said transferred ink on said blankets intended to collectively form a complete image on printing paper, and said blankets intended to be successively contacted to printing paper in a predetermined order;

each of said blankets is contacted the respective printing plates the colors of which are intended to be printed preceding that of each of said blankets, so that color ink of the respective preceding color printing plates is transferred to each of said blankets so as to reduce the tendency of a previously printed ink from adhering to each blanket which is thus provided with the same color ink; and said blankets are successively pressed in a predetermined order onto a sheet of printing paper to transfer the ink on each of said blankets to the printing paper.

2. A method of multi-color offset printing wherein:

each of a plurality of blankets is contacted with respective color printing plates the colors of which are intended to be printed preceding that of each of said blankets, so that color ink of said respective preceding color printing plates is transferred to each of said blankets so as to reduce the tendency of a previously printed ink from adhering to each blanket which is thus provided with the same color ink;

thereafter, each of said plurality of blankets is contacted with respective corresponding color printing plates so as to transfer a different, respectively-colored ink to each of said blankets, said ink on said blankets transferred according to the foregoing step being intended to collectively form a complete image on printing paper; and said blankets are successively pressed in a predetermined order onto a sheet of printing paper to transfer the ink on each of said blankets to the printing paper.

3. A method as defined in claim 2 or 4, wherein whenever color ink is transferred from one of said printing plates to one of said blankets for the purpose of reducing the tendency of a previously printed ink from adhering to each blanket which is thus provided with the same color ink, each color ink is fed to the respective color printing plates.

4. A method of multi-color offset printing comprising the steps of:

contacting a first color printing plate with a blanket for a first color, a second color plate with a blanket for a second color, a third color printing plate with a blanket for a third color and a fourth color printing plate with a blanket for a fourth color respectively to transfer each color ink from each of said color printing plates to each of said blankets;

thereafter contacting the first color printing plate with the second, third and fourth blankets, the second color printing plate with the third and the fourth blankets, the third color printing plate with the fourth blanket respectively to transfer each color ink to each of said blankets from the respective color printing plates; and pressing the first, second, third and fourth blankets onto a sheet of printing paper in the foregoing order to transfer each color ink to the printing paper one after another.

5. A method of multi-color offset printing comprising the steps of:

(a) contacting a first color printing plate with a blanket for a first color, a second color printing plate with a blanket for a second color, a third color printing plate with a blanket for a third color and a fourth color printing plate with a blanket for a fourth color respectively to transfer each color ink from each of said color printing plate to the respective blankets;

(b) contacting the first color printing plate with the second, third and fourth blankets, the second color printing plate with the third and fourth blankets and the third color printing plate with the fourth blanket respectively to transfer each color ink from each of the color printing plates to the respective blankets;

(c) contacting the first color printing plate with the blanket for the first color, the second color printing plate with the blanket for the second color, the third color printing plate with the blanket for the third color and the fourth color printing plate with the blanket for the fourth color respectively to transfer each color ink from each of said color printing plates to the respective blankets; and next pressing each of the first, second, third and fourth blankets onto a sheet of printing paper in the foregoing order to transfer each color ink on the respective blankets to the printing paper one after another.

6. A method of multi-color offset printing comprising the steps of:

contacting a first color printing plate with a blanket for a second color, a blanket for a third color and a blanket for a fourth color, a second color printing plate with the blanket for the third color and the blanket for the fourth color, and a third color printing plate with the blanket for the fourth color, respectively, to transfer each color ink from each of the color printing plates to the respective blankets;

thereafter contacting the first color printing plate with the blanket for the first color, the second color printing plate with the blanket for the second color, the third color printing plate with the blanket for the third color and the fourth color printing plate with the blanket for the fourth color, respectively, to transfer each color ink from each of said color printing plates to the respective blankets; and pressing each of the first, second, third and fourth blankets onto a sheet of printing paper in the foregoing order to transfer each color ink on the respective blankets to the printing paper one after another.

7. A method as defined in claim 5 or 6, wherein whenever color ink is transferred from one of said color printing plates to a non-numerically corresponding one of said blankets, each color ink is fed to the respective color printing plates.

* * * * *